US007357185B2

(12) United States Patent
Walker

(10) Patent No.: US 7,357,185 B2
(45) Date of Patent: Apr. 15, 2008

(54) SUBSEA TUBING HANGER ASSEMBLY FOR AN OIL OR GAS WELL

(75) Inventor: Timothy Walker, Houston, TX (US)

(73) Assignee: BHP Billiton Petroleum Pty. Ltd., Melbourne, Vic (AU)

( * ) Notice: Subject to any disclaimer, the term of this patent is extended or adjusted under 35 U.S.C. 154(b) by 0 days.

(21) Appl. No.: 10/565,995

(22) PCT Filed: Jul. 5, 2004

(86) PCT No.: PCT/AU2004/000904

§ 371 (c)(1),
(2), (4) Date: Jun. 26, 2006

(87) PCT Pub. No.: WO2005/008025

PCT Pub. Date: Jan. 27, 2005

(65) Prior Publication Data

US 2007/0029079 A1 Feb. 8, 2007

Related U.S. Application Data

(60) Provisional application No. 60/488,227, filed on Jul. 17, 2003.

(51) Int. Cl.
*E21B 29/12* (2006.01)

(52) U.S. Cl. ..... 166/344; 166/89.2; 166/89.3; 166/382

(58) Field of Classification Search ..... 166/348, 166/344, 338, 368, 89.2, 89.3, 382, 208
See application file for complete search history.

(56) References Cited

U.S. PATENT DOCUMENTS 3,059,698 A * 10/1962 Burns et al. ..... 166/97.5
3,734,179 A 5/1973 Smedley
3,739,846 A * 6/1973 Beson ..... 166/89.2
3,806,168 A * 4/1974 McGee et al. ..... 285/123.2
3,814,179 A * 6/1974 Hull, Jr. ..... 166/89.2
4,154,298 A * 5/1979 Gano ..... 166/85.5
4,252,187 A * 2/1981 Wilson ..... 166/115
4,386,656 A * 6/1983 Fisher et al. ..... 166/117.5
4,491,176 A * 1/1985 Reed ..... 166/66.4
4,736,799 A * 4/1988 Ahlstone ..... 166/348
4,880,061 A * 11/1989 Ahlstone ..... 166/348
5,377,762 A * 1/1995 Turner ..... 166/339
5,706,893 A * 1/1998 Morgan ..... 166/86.1

(Continued)

FOREIGN PATENT DOCUMENTS

CA 2327987 6/2001

(Continued)

*Primary Examiner*—Thomas A Beach
(74) *Attorney, Agent, or Firm*—Brinks Hofer Gilson & Lione; G. Peter Nichols

(57) ABSTRACT

A subsea tubing hanger assembly is disclosed which comprises a tubing hanger (12) having a plurality of conduits (14). A pup joint (16) is connected to the hanger (12) and a shroud (20) surrounds the pup joint (16). A plurality of extension capillary tubings (30) are connected to respective conduits (14) and extend between the shroud (20) and pup joint (16) to a position exterior of the shroud (20). The tubings (30) are provided with a connector (40) at their ends to facilitate connection of the tubings (30) to capillary tubings (50) of a well.

8 Claims, 2 Drawing Sheets

U.S. PATENT DOCUMENTS

| | | | | |
|---|---|---|---|---|
| 5,875,849 | A * | 3/1999 | Martin et al. | 166/382 |
| 5,887,658 | A * | 3/1999 | Tison | 166/348 |
| 5,992,527 | A * | 11/1999 | Garnham et al. | 166/379 |
| 6,015,009 | A * | 1/2000 | Allen | 166/89.3 |
| 6,046,404 | A | 4/2000 | Figenschou et al. | |
| 6,053,252 | A * | 4/2000 | Edwards | 166/348 |
| 6,070,668 | A * | 6/2000 | Parks et al. | 166/345 |
| 6,082,460 | A * | 7/2000 | June | 166/348 |
| 6,146,052 | A | 11/2000 | Jacobsen et al. | |
| 6,494,266 | B2 * | 12/2002 | Bartlett et al. | 166/339 |
| 6,530,433 | B2 | 3/2003 | Smith et al. | |
| 6,702,015 | B2 | 3/2004 | Fielder, III et al. | |
| 6,715,554 | B1 * | 4/2004 | Cunningham et al. | 166/348 |
| 7,156,169 | B2 * | 1/2007 | Bartlett | 166/66.7 |
| 2004/0079532 | A1 * | 4/2004 | Allen et al. | 166/379 |
| 2004/0104024 | A1 * | 6/2004 | Kent et al. | 166/85.4 |
| 2007/0023189 | A1 * | 2/2007 | Kahn et al. | 166/348 |

FOREIGN PATENT DOCUMENTS

| | | |
|---|---|---|
| GB | 2 371 062 | 7/2002 |
| WO | WO 98/36153 | 8/1998 |

* cited by examiner

SUBSEA TUBING HANGER ASSEMBLY FOR AN OIL OR GAS WELL

This application claims priority to PCT application Ser. No. PCT/AU/2004/000904 filed Jul. 5, 2004 published in English on Jan. 27, 2005 as PCT WO 2005/008025 and to U.S. Provisional Application Ser. No. 60/488,227 filed Jul. 17, 2003, the entire contents of both are incorporated herein by reference.

FIELD OF THE INVENTION

This invention relates to a subsea tubing hanger assembly for connection to a subsea tree of an oil or gas well.

BACKGROUND ART

A tubing hanger is installed in a well in order to achieve a conduit between a producing reservoir of oil or gas and the surface and to provide well control and protection to the localised environment. The tubing hanger is used to support tubulars that also aid in retrieving these hydrocarbons. Typically these tubulars can range from 2-⅜ inch outside diameter to 9-⅝ inch outside diameter. A typical tubing hanger is about 18-¾ inch in outside diameter at the top and 9-⅝ inch at the bottom, and is designed to fit to a subsea tree of the well where it is pressure tested.

In the majority of subsea wells, the quality of the produced fluids and the addition of components such as subsurface safety valves and bottom hole pressure gauges require that small capillary tubing be installed in the well. The capillary tubing can be in-the form of a control line used to transport chemicals to chemical injection valves or to provide hydraulic fluids to mechanical devices. The capillary tubing can also be in the form of I-wire (have I-wire installed internally) used to transport electrical signals to and from downhole devices such as pressure gauges.

In a typical offshore installation, the capillary tubing is clamped to the tubing as it is run into the well, and then terminated at the tubing hanger. The connection of the capillary tubing to the hanger is time consuming and difficult, bearing in mind that this operation is often performed on a floating offshore rig, and sometimes in severe weather conditions. Typically the control line is connected to the hanger between a shroud and a tubing in the form of a pup joint through which the hydrocarbons flow. The capillary tubing must fit between the shroud and pup joint and be connected and tested pressure tight. The time to make up these connections can be considerable, therefore adding significantly to the cost of installing the capillary tubing in a well.

SUMMARY OF THE INVENTION

The object of the invention is to overcome this problem.

The invention therefore provides a subsea tubing hanger assembly for connection to a subsea tree of an oil or gas well, comprising:

- a tubing hanger having at least one control conduit;
- a joint coupled to the tubing hanger;
- a shroud coupled to the tubing hanger and surrounding the joint;
- at least one extension capillary tubing connected to the at least one conduit and extending between the shroud and the joint to a position exterior of the shroud; and

- a capillary tubing connector on the at least one capillary tubing exterior of the shroud to enable connection of the extension capillary tubing to a capillary tubing of the well.

Since the hanger assembly is provided with the extension capillary tubing which extends to the exterior of the shroud and has the connector exterior of the shroud, the extension capillary tubing can be much more easily connected to the capillary tubing of the well on a floating offshore rig, thereby significantly reducing the time for making the connections, and therefore the cost in installing the capillary tubing.

Preferably the joint is a pup joint. However, in some cases a full joint may be used.

Preferably a plurality of extension capillary tubings are connected to respective conduits of the hanger and which extend to a position exterior of the shroud and have a respective connector for connection to respective capillary tubing of the well.

Preferably the or each connector is in the form of a ferrule nut, autoclave or jam nut fitting. However, other connectors used for joining capillary tubing to a fixed point could be used.

Preferably the or each extension capillary tubing is connected to an anti-torque mechanism for at least reducing rotation of the extension capillary tubing when the capillary tubing of the well is connected to the connector.

Preferably the mechanism comprises a shroud plate located between the pup joint and the shroud and having an aperture for each of the extension capillary tubing to hold the extension capillary tubing and prevent rotation of the extension capillary tubing to thereby prevent torque from being applied through the extension capillary tubing to the connection between the extension capillary tubing and the hanger.

Preferably the extension capillary tubing has a cross-sectional shape at least at the location where the extension capillary tubing passes through the aperture of the shroud plate which matches the shape of the aperture to prevent rotation of the extension capillary tubing relative to the plate.

Preferably the cross-sectional shape is hexagonal, but other cross-sectional shapes or anti-torquing devices could be used.

BRIEF DESCRIPTION OF THE DRAWINGS

A preferred embodiment of the invention will be described, by way of example, with reference to the accompanying drawings in which.

DETAILED DESCRIPTION OF THE PREFERRED EMBODIMENT

Figure 1:
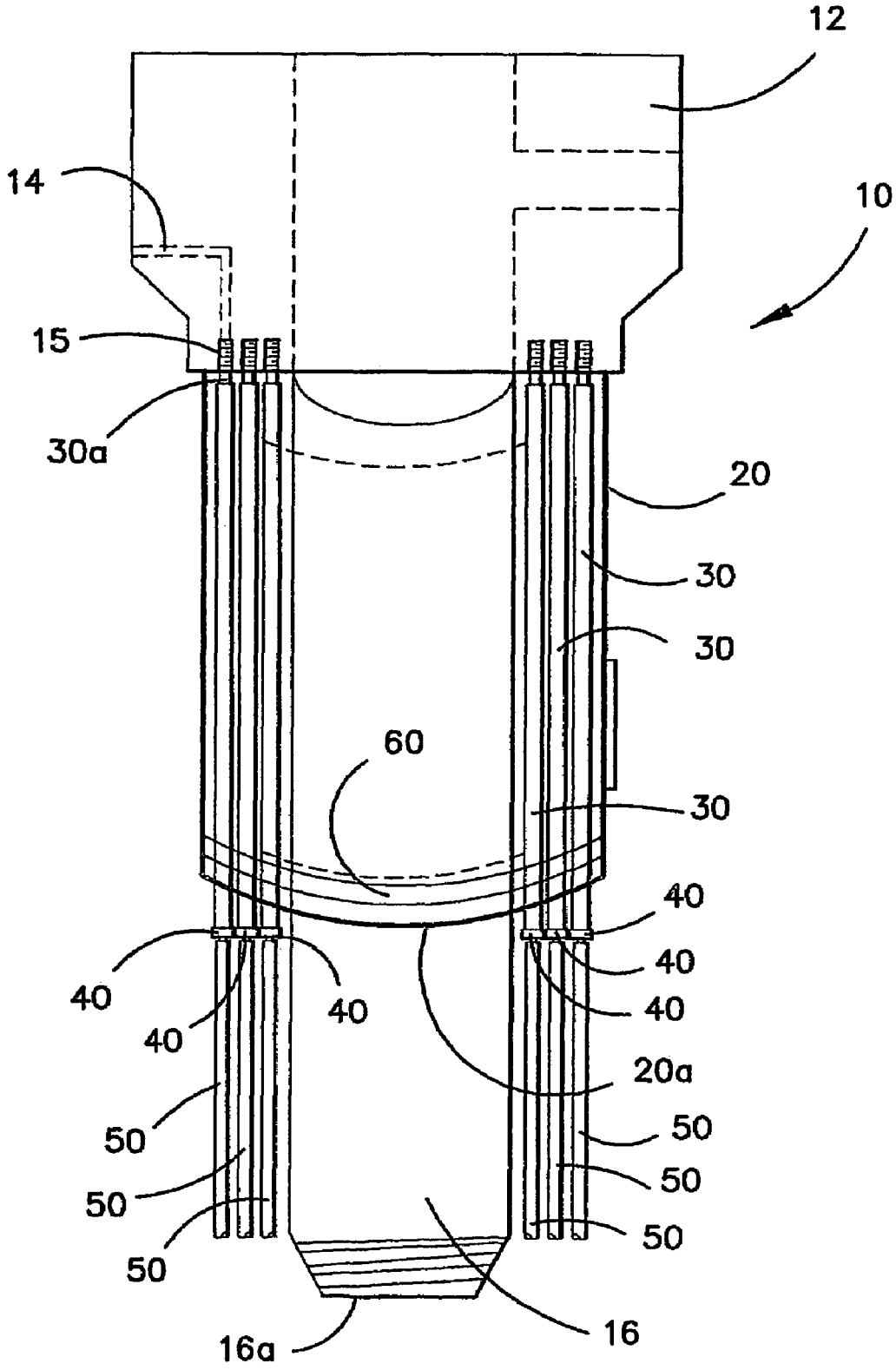
FIG. 1 is a view of a tubing hanger assembly according to the preferred embodiment of the invention.

With reference to FIG. 1, a tubing hanger assembly 10 is shown which comprises a tubing hanger 12. The tubing hanger 12 includes a plurality of conduits 14 (only one shown) through which fluid or electrical wires can pass to respective capillary tubing either in the form of a control line in the case of a fluid, or an I-wire in the case of an electrical signal, or in the form of a fibre optic line in the case of downhole fibre optics equipment.

A pup joint 16 is connected to the tubing hanger 12 and forms a piping through which hydrocarbons can pass from the reservoir (not shown) which is tapped by the well (not shown) to the surface for further processing.

A shroud 20 surrounds the pup joint 16 and terminates before the end of the pup joint 16 as is clearly shown in FIG. 1. A plurality of extension capillary tubing 30 (seven tubings in the embodiment of FIG. 1 of which only six can be seen in that figure) are connected to respective conduits 14 by, for example, providing a screw threaded bore 15 in the tubing hanger 10 into which a screw threaded end 30*a* of the extension capillary tubing 13 is screwed. The extension capillary tubing 30 extends between the shroud 20 and the pup joint 16 to a position exterior of the shroud 20. Most preferably the extension capillary tubing 13 terminates at a position between end 20*a* of the shroud 20 and the end 16*a* of the pup joint 16.

Each of the capillary tubings 30 is provided with a connector 40 at its end which is exterior of the shroud 20. The connector 40 may be in the form of a ferrule nut, autoclave or jam nut fitting or other similar type connections. The connectors 40 enable capillary tubing 50 of the well to be connected to the capillary extension tubing 30 to thereby provide a continuous capillary tubing, either in the form of a control line for fluids or an I-wire for electrical signals between the tubing hanger 12 and the subsea tree of the well to which the tubing hanger assembly is to be coupled.

Because the connectors 14 are exterior of the shroud 20, the capillary tubing 50 is much more easy to connect than if no extension capillary tubing is provided, and it is therefore necessary to attempt connection of the capillary tubing 50 direct to the tubing hanger 12. Thus, the amount of time, and therefore the cost of forming the required connection of the control line or I-wire is greatly reduced.

Figure 2:
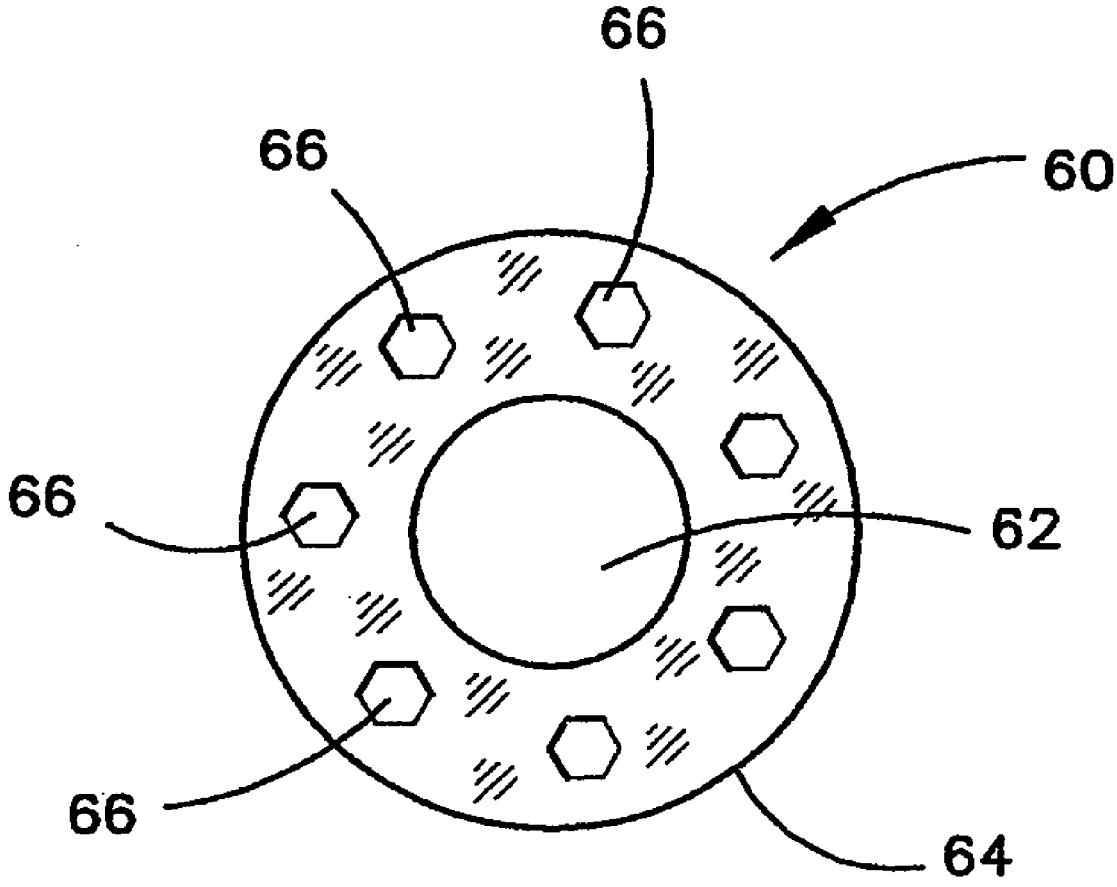
FIG. 2 is a view of a shroud plate used in the embodiment of FIG. 1.

A shroud plate 60 is preferably provided between the shroud 20 and the pup joint 16, and is best shown in FIG. 2. The shroud plate 60 is generally annular in configuration and has a central hole 62 which accommodates the pup joint 16. The plate 60 can be connected to the pup joint 16 and/or shroud 20 to thereby secure the plate in position. The plate 60 has a number of apertures 66. A respective one of the extension capillary tubings 30 passes through a respective one of the apertures 66. As is best shown in FIG. 2, the apertures 66 have a hexagonal shape and the extension tubings 30 are also provided with a corresponding hexagonal shape, at least at the position where the tubings 30 pass through the plate 60. The tubing 30 is a tight fit in the apertures 66, and the shape of the apertures 66 and corresponding shape of the tubings 30 prevents rotation of the tubings 30, and therefore prevents torque from being applied through the length of the extension tubings 30 to the screw threads 15 and 30*a* when a wrench is used to connect the connectors 40 to the tubings 50. Thus, screw thread connection 15 and 30*a* is therefore not likely to be loosened or undone during coupling of the extension tubings 30 to the tubings 50.

The connectors 40 may themselves have a hexagonal shape to make it easy for a wrench to be applied to the connectors during the coupling of the connectors 40 to the capillary tubing 50.

Since modifications within the spirit and scope of the invention may readily be effected by persons skilled within the art, it is to be understood that this invention is not limited to the particular embodiment described by way of example hereinabove.

What is claimed is:

1. A subsea tubing hanger assembly for connection to a subsea tree of an oil or gas well, comprising:

a tubing hanger having at least one control conduit;

a joint coupled to the tubing hanger;

a shroud having a first end adjacent the tubing hanger and a second end remote from the tubing hanger, the shroud being coupled to the tubing hanger and surrounding the joint;

at least one extension capillary tubing connected to the at least one conduit and extending between the shroud and the joint to a position exterior of the shroud beyond the second end; and a capillary tubing connector on the at least one capillary tubing and located beyond the second end exterior of the shroud to enable connection of the extension capillary tubing to a capillary tubing of the well.

2. The assembly of claim 1 wherein the joint is a pup joint.

3. The assembly of claim 1 wherein a plurality of extension capillary tubings are connected to respective conduits of the hanger and which extend to a position exterior of the shroud and have a respective connector for connection to respective capillary tubing of the well.

4. The assembly of claim 1 wherein the or each connector is in the form-of a ferrule nut, autoclave or jam nut fitting.

5. The assembly of claim 1 wherein the or each extension capillary tubing is connected to an anti-torque mechanism for at least reducing rotation of the extension capillary tubing when the capillary tubing of the well is connected to the connector.

6. The assembly of claim 5 wherein the mechanism comprises a shroud plate located between the pup joint and the shroud and having an-aperture for each of the extension capillary tubing to hold the extension capillary tubing and prevent rotation of the extension capillary tubing to thereby prevent torque from being applied through the extension capillary tubing to the connection between the extension capillary tubing and the hanger.

7. The assembly of claim 6 wherein the extension capillary tubing has a cross-sectional shape at least at the location where the extension capillary tubing passes through the aperture of the shroud plate which matches the shape of the aperture to prevent rotation of the extension capillary tubing relative to the plate.

8. The assembly of claim 7 wherein the cross-sectional shape is hexagonal, but other cross-sectional shapes or anti-torquing devices could be used.

* * * * *